United States Patent [19]

Takeich et al.

[11] Patent Number: 4,993,329

[45] Date of Patent: Feb. 19, 1991

[54] CAR BODY FOR RAILWAY ROLLING STOCK AND METHOD OF FABRICATING THE CAR BODY

[75] Inventors: Michifumi Takeich; Sumio Okuno; Keiji Ohmura; Masato Okazaki; Hitoshi Tsuruda, all of Kudamatsu, Japan

[73] Assignee: Hitachi, Ltd., Tokyo, Japan

[21] Appl. No.: 362,045

[22] Filed: Jun. 6, 1989

[30] Foreign Application Priority Data

Jun. 6, 1988 [JP] Japan ..... 63-137568

[51] Int. Cl.[5] ..... B61D 17/00

[52] U.S. Cl. ..... 105/401; 105/396

[58] Field of Search ..... 105/396, 397, 401, 408, 105/409, 414; 296/196, 197; 29/469

[56] References Cited

U.S. PATENT DOCUMENTS 3,774,553 11/1973 Kunst et al. ..... 105/409
4,059,303 11/1977 Mauri ..... 29/469
4,209,892 7/1980 Hofstaedter et al. ..... 105/401

*Primary Examiner*—Joseph F. Peters, Jr.
*Assistant Examiner*—Virna Lissi Mojica
*Attorney, Agent, or Firm*—Antonelli, Terry, Stout & Kraus

[57] ABSTRACT

A car body of a railway rolling stock wherein the entire car body is divided into a plurality of blocks or modules which are subsequently combined and connected. The individual blocks or modules include a roof construction forming a roof of the car body, side constructions forming respective side walls of the car body, end constructions adapted to be disposed at respective longitudinal ends of the car body to form an end thereof, and an underframe for forming a lower surface of the body. The roof construction, the side constructions and at least one of the side constructions, an underframe are connected through connecting members in which a connected end is extended toward the roof construction, the side constructions or the side constructions and the underframe to be connected, with the entirety being integrally formed by extruded shaped alloy members and arranged to extend in a longitudinal direction of the car body.

18 Claims, 3 Drawing Sheets

CAR BODY FOR RAILWAY ROLLING STOCK AND METHOD OF FABRICATING THE CAR BODY

BACKGROUND OF THE INVENTION

The present invention relates to railway rolling stock and, more particularly, to a car body for railway rolling stock and a method of fabricating the car body wherein the entire car body is divided into a plurality of individual prefabricated modules or blocks which are subsequently combined to form the entire car body.

Generally, a car body for railway rolling stock includes an underframe assembly, a side construction, a roof construction and an end construction, with the underframe assembly and side roof and end constructions being separately preassembled as individual blocks or modules which are subsequently combined. To facilitate a combining of the individual blocks or modules, suitable connecting or joining elements are provided along respective outer peripheral portions of the underframe assembly and side, roof, and end constructions.

In, for example, Japanese Utility Model Publication No. 5983/1988, a car body for railway rolling stock of the aforementioned type is proposed wherein the end, side and roof constructions and the underframe assembly are combined through connecting or joining elements or members provided along the outer periphery thereof with such connecting or joining elements exhibiting a certain degree of rigidity in order to prevent the individual blocks or modules from being deformed when the blocks or modules are fabricated. Consequently, the connecting or joining elements are generally fashioned as shaped alloys having a relatively thick wall construction and, in the connected portion between the respective blocks or modules, the joining or connecting elements are superposed to each other so that the weight of the entire body tends to increase.

By virtue of the utilization of joining or connecting elements for connecting the respective individual blocks or modules of the car body, the overall number of individual components forming the respective blocks or modules tends to increase; however, with a recent trend of higher speed railway rolling stock, an increase in the weight of the body has a great influence on the tracks for the railway rolling stock which is disadvantageous inasmuch as considerable labor is required for maintaining a safe condition of the tracks. Moreover, an increase in the body weight of the railway rolling stock tends to increase the overall power consumption.

In light of the above-noted problems, there has been a trend to reduce the number of connecting or joining elements in order to decrease the body weight; however, with such an approach the rigidity or strength of the entire car body is possibly lowered. Additionally, with a reduction in the rigidity of the blocks or individuals modules, considerably more labor is required to move or assemble the blocks or modules of the car body by virtue of the reduced rigidity.

The aim underlying the present invention essentially resides in providing a car body for railway rolling stock which avoids, by simple means, shortcomings and disadvantages encountered in the prior art.

Yet another object of the present invention resides in providing a lightweight car body for railway rolling stock composed of a plurality of individual prefabricated body blocks or modules with the respective body blocks or modules having a sufficient rigidity to facilitate movement and assembly thereof.

Yet another object of the present invention resides in providing a car body for railway rolling stock wherein the entire car body has a high rigidity.

A still further object of the present invention resides in providing a car body for railway rolling stock which reduces the overall number of components forming the car body without adversely affecting the overall safety and rigidity of the car body thereby facilitating the fabrication of the individual car body blocks or modules as well as the subsequent combining of the individual body blocks or modules.

The above and other objects, features, and advantages of the present invention will become more apparent from the following description when taken into connection with the accompanying drawings which show, for the purposes of illustration only, several embodiments in accordance with the present invention.

DETAILED DESCRIPTION

Figure 1:
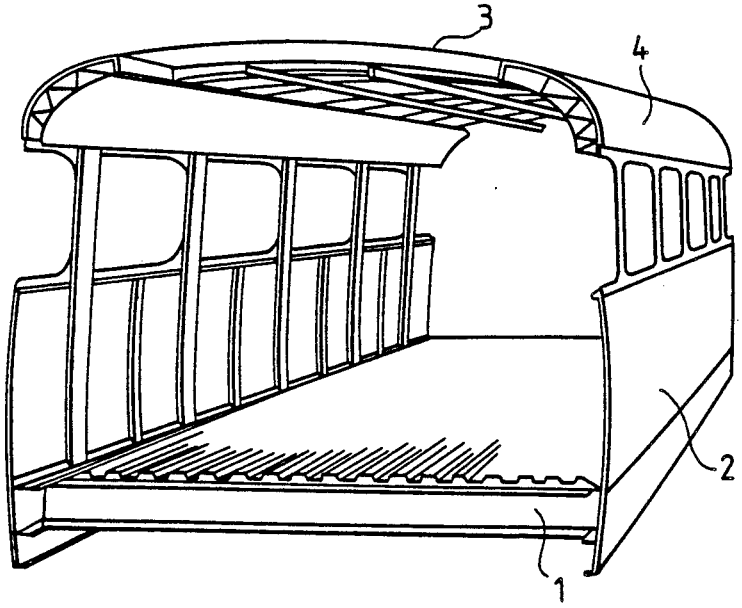
FIG. 1 is a perspective view of one embodiment of a car body for a railway rolling stock constructed in accordance with the present invention.
Figure 2:
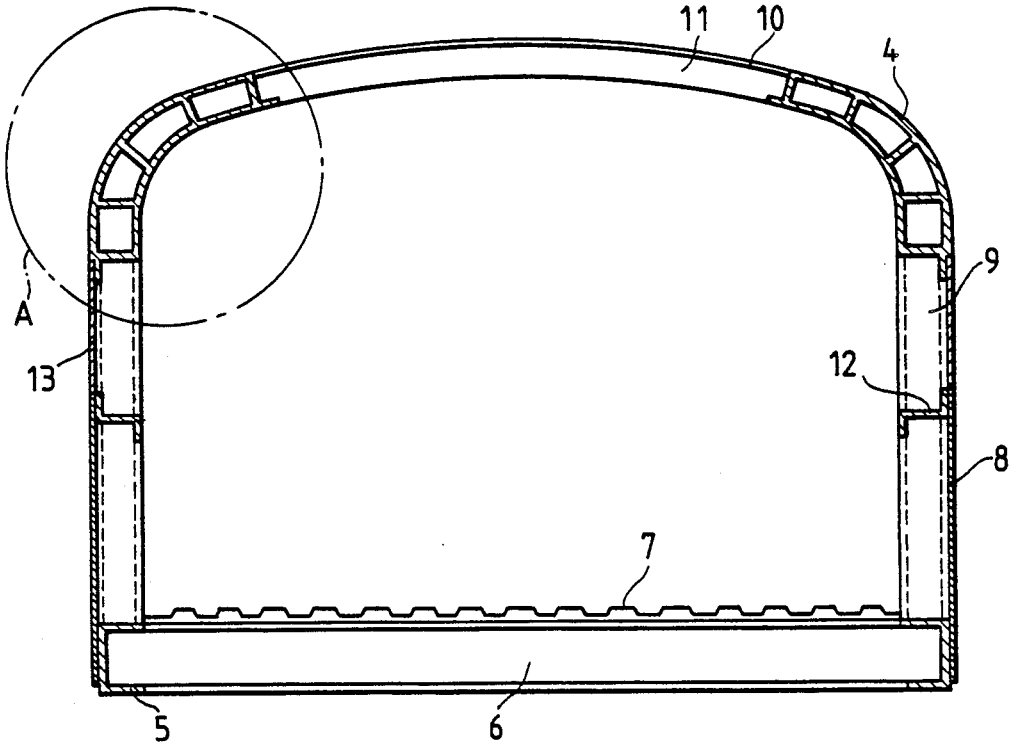
FIG. 2 is a transverse cross-sectional view of the car body of FIG. 1.

Referring now to the drawings wherein like reference numerals are used throughout the various views to designate like parts and, more particularly, to FIGS. 1–4, according to these figures, a car body for railway rolling stock includes an underframe 1 forming a lower surface of the car body, with the underframe 1 including side sills 5, cross-beams 6, and a corrugated plate 7. The side posts 5 are arranged so as to extend in a longitudinal direction of the car body and are disposed on respective sides thereof, with the cross beams 6 extending widthwise or transversely of the car body between the two side posts 5. The corrugated plate 7 is arranged on an upper surface of the cross beam 6 so as to cover an upper surface of the underframe 1.

The side construction 2 forming respective sides of the car body includes a side plate 8, a side post 9, and a belt rail 12. The side post 9 is arranged on the underframe 1 so as to extend in a vertical direction, with the belt rail 12 extending perpendicularly to the side post 9. The outer side plate is mounted on the outer surface of the side post 9 and the belt rail 12, with the side post 9 and the belt rail 12 being constructed so as to enable the support of a window unit 13. A reinforcing material (not shown) may optionally be provided along a backside of the outer side plate 8 and extend parallel to the belt rail 12.

A roof construction 3 of the car body 1 includes a roof outer sheet 10 and a roof liner or carline 11, with the roof liner or carline 11 being arranged so as to extend widthwise or transversely of the car body, and with the roof outer sheet 10 being mounted on an exterior or outer surface of the roof liner or carline 11.

Figure 3:
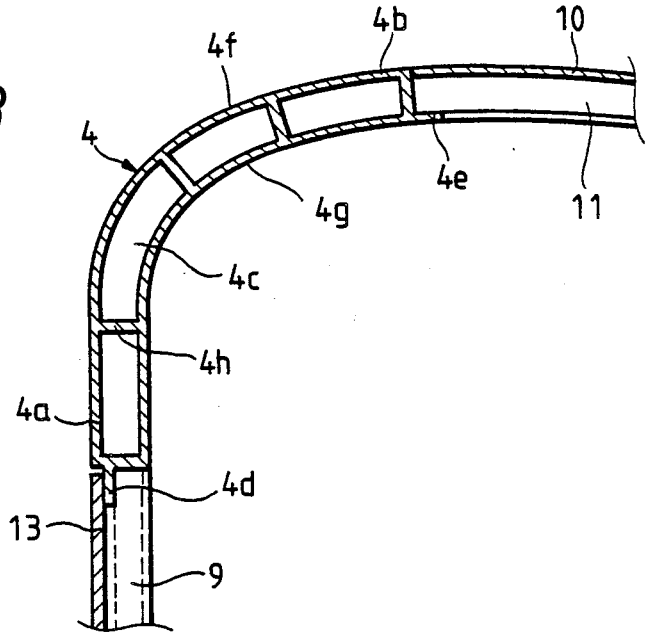
FIG. 3 is an enlarged cross-sectional view of the detail A in FIG. 2.
Figure 4:
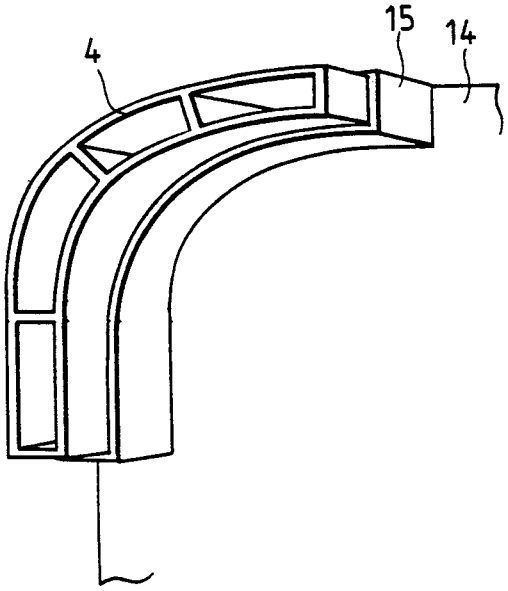
FIG. 4 is a perspective view of a connecting portion of an end construction of an upper connecting or joining member in the car body of FIG. 1.

An upper connecting or joining member 4 is provided for connecting the side construction 2 and the roof construction 3 with the upper connecting member 4, as shown most clearly in FIG. 4, having a closed cross-sectional shape and being formed from an extruded shaped member of a light alloy such as, for example, aluminum. The upper connecting member 4, as shown in FIG. 1, extends in a longitudinal direction of the car body and, as shown in FIG. 3, includes a lower connecting end **4*a*, a lower end of which is extended in a direction toward the side construction 2, and an upper connecting end 4*b* extending in a direction of the roof construction 3. The lower connecting end 4*a* is formed or shaped so as to register with an upper side portion of a window opening in which the window unit 13 is accommodated. The lower connecting end 4*a* of the connecting or joining member 4 is also formed so that an outer surface thereof constitutes a continuous surface of the outer surface of the outer side plate 8 of the side construction 2. Thus, if, for example, the outer surface of the side construction 2 is a curved surface, the outer surface of the lower connecting end 4*a* forms a curved surface continuous with the outer surface of the side construction 2**.

The upper connecting end **4*b* is formed so that the outer surface 4*f* thereof forms a surface continuous with the roof outer sheet 10 of the roof construction 3**.

The outer surface **4*f* of the upper connecting or joining member 4 is formed so as to be arcuate and smoothly connect the outer surfaces of the lower connecting end 4*a* and the upper connecting end 4*b* of the connecting or joining member 4. An inner surface 4*g* of the upper connecting member 4 is also formed so as to be arcuate and has an outer surface 4*f*. The lower connecting end 4*a* of the upper connecting or joining member 4 is formed with a projection 4*d* which extends in a direction toward the side construction 2, with the projection 4*d* being provided to connect the side construction 2 and the upper connecting or joining member 4. The upper connecting end 4*b* of the upper connecting or joining member 4 is formed with a projection 4*e* extending or projecting toward the roof construction 3 and is provided for connecting the roof construction 3 and the upper connecting or joining member 4. Since the lower connecting end 4*a* of the upper connecting or joining member 4 is registered with the upper edge of the window opening portion accommodating the window unit 13, the side construction 2 forms a portion by which the side sill 5 of the underframe 1 is connected to the lower connecting end 4*a* of the upper connecting or joining member 4**.

In fabricating the side construction 2, the upper connecting or joining member 4 is connected to the upper end of the side construction 2 which itself is connected to the side sill 5 of the underframe 1 thereby improving the overall rigidity of the side construction 2 which considerably facilitates the subsequent labor in assembling the other car body locks or modules to each other.

As shown most clearly in FIG. 3, the upper connecting or joining member 4 is fashioned so that a hollow portion **4*c* is defined by a pair of partitioning walls 4*h* formed between an outer wall and inner wall of the upper joining or connecting member 4**.

An end construction 14 forms the respective ends of the car body 1, with the end construction 14 being fashioned by combining and connecting a vertical member (not shown) and a horizontal member (not shown) and connecting an outer plate to outer surfaces of the horizontal member and vertical member. An end receiving member 15 is provided on the end construction 14 and is adapted to accommodate a body of the upper connecting or joining member 4, with the end receiving member 15 having a cross-sectional shape in which the upper connecting member 4 can be connected to the end receiving member 15. The end receiving member 15 is positioned above both lateral sides of the end construction 14. To assemble the car body described hereinabove, the underframe 1 is constructed by first arranging the side sills 5 in parallel to each other at a predetermined lateral spacing from each other. A plurality of cross beams 6, spaced from each other in a longitudinal direction of the car body, are arranged between the side sills 5 and are connected thereto, after which the corrugated plate 7 is connected to the side sill 5 and the cross beams 6.

The side construction 2 is fabricated such that first the side post 9 and the belt rail 12 are combined, the upper connecting member 4 is arranged on the upper end of the side post 9 and connected thereto, with the side outer plate 8 being connected to the outer surfaces of the side post 9 and the belt rail 12. An upper side of the outer side plate 8 is connected to the projection **4*d* of the upper connecting or joining member 4**.

In fabricating the roof construction 3, the roof liner 11 is connected to the respective upper connecting ends **4*b* of the upper joining or connecting member and extends in a longitudinal direction of the car body after which the outer roof sheet 10 is connected to the roof liner or carline 11**.

The end construction 14 is fabricated in such a manner that the vertical and horizontal members are combined after which the outer plate of the end construction 14 is connected thereto and the end receiving member 15 is provided at both upper portions of the end construction 14 on both lateral sides of the car body.

After the individual modules or blocks forming the underframe 1, side construction 2, roof construction 3, and end construction 4 are fabricated they are combined and connected. First, on an upper surface of both lateral sides of the car body, the side construction 2 is arranged at a right angle to the upper surface of the underframe 1 and connected thereto. The roof construction 3 is constructed such that the roof liner or carline 11 is connected to a purlane arranged in a longitudinal direction of the car body, after which the roof outer plate 10 is connected. After the underframe 1, side construction 2, and roof construction 3 are assembled in the above-described manner, the end construction 14 is mounted at respective longitudinal ends of the assembled car body and, at this time, the end of the upper connecting or joining member 4 of the side construction 2 and the end receiving member 15 of the end construction 14 are fitted to each other.

With the car body arrangement described above, the upper connecting or joining member 4 is formed so that the entire assembly assumes a closed section and therefore the overall construction exhibits a high rigidity. Accordingly, since the side construction 2 and the roof construction 3 are connected through the upper connecting or joining member 4, the overall rigidity of the connected portions is greatly improved thereby improving the overall rigidity of the entire car body. Moreover, since the upper connecting or joining member 4 is made of a light alloy, the upper connecting or joining member 4 may have a reduced weight thereby reducing the overall weight as compared with a conventional construction wherein the connecting or joining members are superposed. Moreover, since the lower end of the upper connecting or joining member 4 is formed up to the upper side of the window opening accommodating the window unit 13, the overall number of required components or parts forming the side construction 2 can be reduced.

While the entire upper connecting or joining member 4 disposed at respective lateral sides of the car body may be fashioned as one piece, it is also possible in accordance with the present invention to provide a plurality of individual extruded shaped light alloy members which are subsequently combined and connected. Advantageously, a plurality of holes or openings may be provided in the plurality of extruded shaped alloy members so as to further reduce the weight thereof. Moreover, while a flat plate may be suitably bent to a desired configuration and be utilized as an upper connecting or joining member 4, considerable time and labor would be required during the fabrication of the car body thereby increasing the overall manufacturing costs thereof.

To prevent a stress concentration and improve the overall strength of the upper or connecting joining member 4, the upper or joining member 4 is provided with an inner surface 4*g* formed as an arcuate surface. When railway rolling stock runs at a high speed within a tunnel, a phenomenon occurs in which pressure outside the vehicle rapidly varies; however, even with such a variation of pressure outside the vehicle, a pressure resisting construction is insured by virtue of the provision of the inner surface 4*g* of the upper connecting or joining member 4 when the inner surface 4*g* has an arcuate configuration.

By virtue of the provision of the downwardly extending lower connecting end 4*a* on the upper joining or connecting member 4, it is no longer necessary to utilize, for example, a window head and a vertical rib member as conventionally employed for the side construction 2. Moreover, since the upper connecting or joining member 4 includes a horizontally extending upper connecting end 4*b*, the number of previously employed components for the roof construction 3 can also be considerably reduced. Additionally, by utilizing the upper connecting or joining member 4 constructed in accordance with the present invention, it is possible to reduce the overall number of components formed in the side construction 2 and roof construction 3 thereby considerably reducing the time and labor required to fabricate the side construction 2 and roof construction 3.

Additionally, since the upper connecting or joining member 4 is provided with upper and lower projections 4*d* and 4*e*, a positioning of the side construction 2 and roof construction 3 for enabling a connection of the respective elements can easily be accomplished and the overall fabrication of the car body of the railway rolling stock is facilitated. Moreover, the side construction 2 and roof construction 3 are connected through the upper connecting or joining member 4 whereby the connected position of the members 4 deviates from a corner section widthwise of the body at which the stress concentration is liable to occur. Thus, the reliability of the connected portions of the respective members of the car body is improved and can be further improved where the connection of the members is effected by way of a welding operation.

After the upper connecting or joining member 4 has been incorporated into the side construction 2, the underframe 1 and the roof construction 3 are connected whereby the rigidity of the side construction 2 is improved by virtue of the incorporation of the upper connecting or joining member 4 whereby the subsequent transportation and positioning of the side construction 2 is greatly facilitated so as to reduce the amount of time necessary for the assembling of the prefabricated blocks or modules forming the car body.

Figure 5:
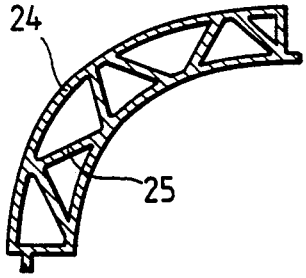
FIG. 5 is a cross-sectional view of a further embodiment of an upper connecting or joining member constructed in accordance with the present invention.

As shown in FIG. 5, an upper connecting or joining member 24 may be provided which includes an internal partitioning wall 25 fashioned into a truss. In all other respects, the upper connecting or joining member 24 is similar to the upper joining or connecting member 4 by virtue of the provision of the partitioning wall 25 so as to form a truss, the rigidity of the upper connecting or joining member 24 can be improved beyond the rigidity achieved by the upper connecting or joining member 4.

Figure 6:
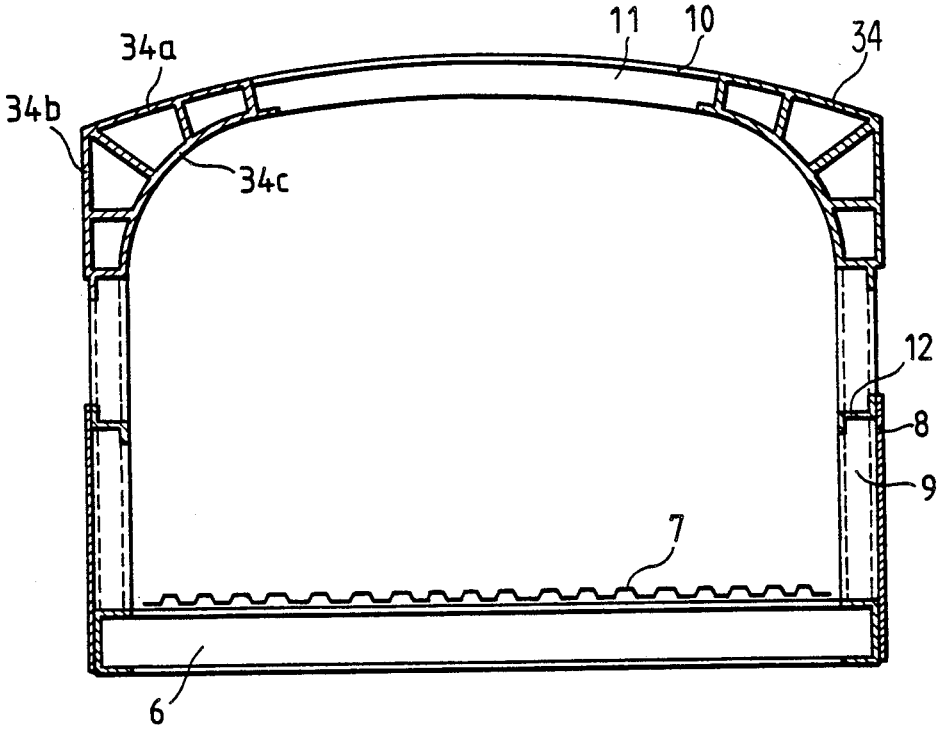
FIG. 6 is a transverse cross-sectional view of a car body for railway rolling stock provided with a modified upper connecting or joining member.

As shown in FIG. 6, an upper connecting or joining member 34 is provided which includes an upper surface 34*a* and a side surface 34*b*, with the upper surface 34*a* and side surface 34*b* being connected at an angle greater than 90°. The upper surface 34*a* forms a surface continuous to a surface of the outer roof sheet 10, and the side surface 34*b* forms a surface continuous with an outer surface of the side construction 2. An inner surface 34*c* of the upper connecting member 34 is formed into an arcuate surface.

Figure 7:
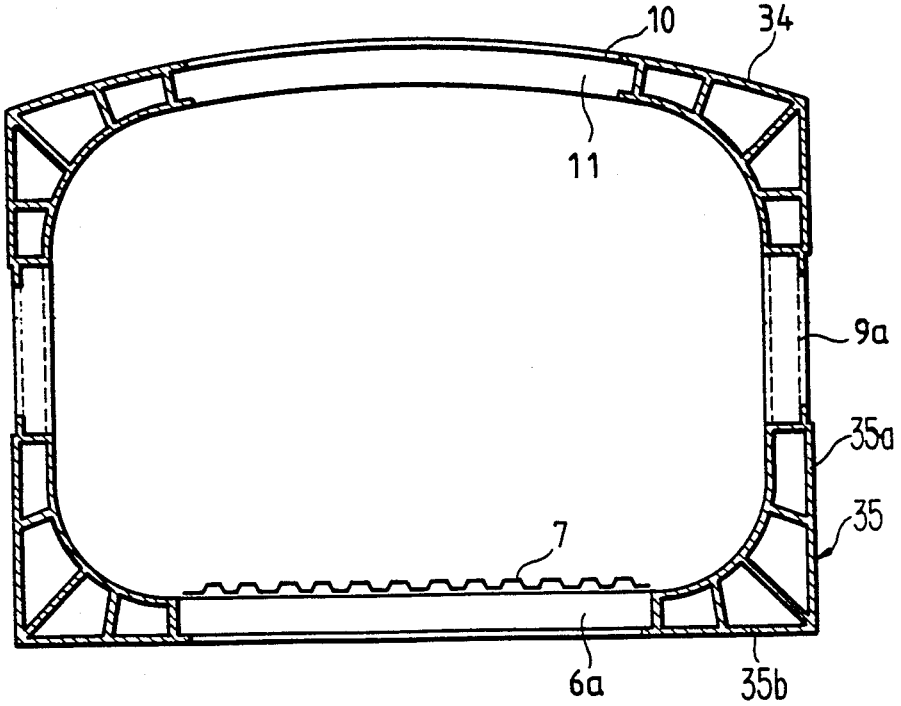
FIG. 7 is a transverse cross-sectional view of a car body for a railway rolling stock provided with a further modified upper connecting or joining member and a lower connecting or joining member of a different construction.

The side construction and roof construction 3 are connected through the upper connecting or joining member 34 whereby a vertical length of the side of the car body can be increased and the section modules of the entire car body with respect to a vertical load can be improved as well as the overall rigidity of the car body. In FIG. 7, a lower connecting joining member 35 is arranged on the underframe 1 along respective lateral sides of the car body, with the lower connecting or joining member 35 including an upper connecting end portion 35*a* integrally formed therewith and extending in a direction of a lower side of a window opening portion provided in the side construction 2. A lower connecting end portion 35*b* of the lower connecting or joining member 35 is integrally formed thereto and extends transversely towards a central portion of the underframe 1 of the car body.

By virtue of the provision of the lower connecting or joining member 35, it is possible to provide cross beams 6*a* which have a shorter length than the cross beam 6 of the underframe 1 in FIG. 1. A side post 9*a*, corresponding to the side post 9 of FIG. 1 but having a shorter length, extends vertically between the upper connecting or joining member 34 and the lower connecting or joining member 35, with the side post 9*a* having a length corresponding to the window opening portion.

To fabricate the car body of FIG. 7, first the two upper connecting or joining members 34 are arranged in parallel to each other with upper surfaces thereof directed downwardly and the outer roof sheet 10 and roof liner or carline 11 are arranged between the upper connecting or joining members 34 and connected thereto.

The thus connected upper construction members are inverted after completion of the connecting work. The two lower connecting or joining members 35 are arranged in parallel and at a lateral spacing from each other and the cross beams 6a are arranged between the lower connecting or joining members 35 and connected thereto. The corrugated plate 7 is subsequently mounted over the cross beams 6a and above the thus fabricated lower construction assembly, the upper construction assembly is located in a predetermined spaced relationship, with the spacing between the upper construction assembly and lower construction assembly being maintained so that the spacing between the lower connected end of the upper connecting or joining member 34 and the upper connected end 35a of the lower connecting or joining member 35 correspond to a vertical dimension of the window opening portion provided in the side construction 2.

With the upper and lower prefabricated assemblies being in such a vertical positioning, the side post 9a are arranged between the lower connected end of the upper connecting or joining member 34 and the upper connected end 35a of the lower connecting or joining member 35, and the upper end of the side post 9a are connected to the lower connected end of the upper connecting or joining member 34 and the lower end of the side post 9a is connected to the upper connected 35a of the lower connecting or joining member 35. By virtue of the last described fabrication or assembly operation, a major portion of the side construction, with the exception of the side post 9a can be integrally constructed by the upper connecting or joining member 34 and the lower connecting or joining member 35 thereby facilitating the overall fabrication of the car body. Moreover, since the upper connecting or joining member 34 and the lower connecting or joining member 35 can be independently separately fabricated, the fabrication is considerably easier than in conventional approaches for manufacturing a side construction of a car body for railway rolling stock.

The upper connecting or joining member 34 and the lower connecting or joining member 35 may be formed as a single large shaped member of a light alloy having a length corresponding to the length of the car body or the upper and lower connecting or joining members 34, 35 may be divided into a plurality of individual members which are subsequently combined and connected. By virtue of the provision of the upper and lower connecting joining members 34, 35, the overall rigidity is high and transportation and positioning of the various constructions during assembly is facilitated whereby an assembly of the entire car body can be efficiently carried out.

While we have shown and described several embodiments in accordance with the present invention, it is understood that the same is not limited thereto but is susceptible to numerous changes and modifications as known to one of ordinary skill in the art, and we therefore do not wish to be limited to the details shown and described herein, but intend to cover all such modifications as are encompassed by the scope of the appended claims.

We claim:

1. A car body for a railway rolling stock, the car body comprising roof means for forming a roof of the car body, a pair of side means for forming respective side walls of the car body, a pair of end means respectively positioned at opposite longitudinal ends of the car body for forming respective ends of the car body, an underframe means for forming a lower portion of the car body, and connecting means for connecting at least one of said roof means and said underframe means to the respective sidewalls of said side means, said connecting means including at least one connecting portion extending at least in a direction toward the roof means, the side means, or the underframe means to enable a connection between the connecting means and the roof means, side means, and underframe means, and wherein the connecting means is constituted by at least one extruded shaped alloy member having opposed inner walls and arranged so as to extend in a longitudinal direction of the car body and at least one integrally formed partition wall provided in the extruded shaped alloy member extending between the opposed inner walls of the member so as to form at least one hollow portion extending continuously in a longitudinal direction of the car body.

2. A car body for a railway rolling stock according to claim 1, wherein said connecting means includes a pair of upper connecting members adapted to connect respective lateral sides of said roof means to respective side walls of the side means of the car body, each of said pair of upper connecting members including a lower connecting end portion extending in a direction of the respective side walls of the side means and an upper connecting end portion extending in a direction of the respective lateral sides of said roof means, and wherein said underframe means includes at least one side sill arranged at respective lateral sides thereof, said side walls of said side means being respectively connected along an upper surface of the respective side sills.

3. A car body for a railway rolling stock according to claim 2, wherein said pair of upper connecting members are formed of a light alloy material.

4. A car body for a railway rolling stock according to claim 3, wherein each of said upper connecting members includes an outer surface continuous to the outer surfaces of said roof means and said side walls of said side means and an inner arcuate smooth surface.

5. A car body for a railway rolling stock according to claim 4, wherein the surface of each of said upper connecting member is continuous to said roof means and the surface continuous to the side walls are connected by an arcuate surface.

6. A car body for a railway rolling stock according to claim 4, wherein the surface of each of said upper connecting members continuous to said roof means and the surface continuous to said side walls are connected at an angle greater than 90°.

7. A car body for a railway rolling stock according to claim 3, wherein each of said upper connecting members is formed by extending the lower connecting end portion thereof to a position of an upper side of at least one window opening portion provided in each of said side walls.

8. A car body for a railway rolling stock according to claim 3, wherein the upper connecting end portion and lower connecting end portion of each of said upper connecting members includes projection means adapted to be respectively connected to the roof means and respective side wall means of said side means.

9. A car body for a railway rolling stock according to claim 1, wherein said connecting means includes a pair of upper connecting members and a pair of lower connecting members each constituted by at least one extruded shaped alloy member, each of said upper connecting members including a first connecting end portion extending in a direction of the roof means and a second connecting end portion extending in a direction of the respective side walls, each of said lower connecting members including a first connecting end portion extending in a direction of the respective side walls and a second connecting end portion extending in a direction of respective lateral sides of the underframe means, said upper connecting members being arranged at respective lateral sides of said roof means for respectively connecting said roof means to the respective side walls of said side means through said first and second connecting end portions of said upper connecting members, said lower connecting members connecting the respective side walls of said side means to the respective lateral sides of said underframe means through said first and second end portions of said lower connecting members.

10. A car body for a railway rolling stock according to claim 9, wherein each of said upper connecting members and said lower connecting members are formed of a light alloy material, and wherein each of said upper connecting members and lower connecting members includes at least one integrally formed partition wall between opposed walls of the respective upper and lower connecting members so as to form at least one hollow portion in the respective upper and lower connecting members.

11. A car body for a railway rolling stock according to claim 10, wherein each of said upper connecting members has an outer surface continuous to outer surfaces of said roof means and respective side walls of said side means and an inner arcuate surface, wherein each of said lower connecting members includes an outer surface continuous to respective outer surfaces of the side walls of said side means and said underframe means and an inner arcuate surface.

12. A car body for a railway rolling stock according to claim 11, wherein the surface of the respective upper connecting members to said outer surface of said roof means and the surface continuous to the outer surface of the respective sidewalls of the side means are connected by an arcuate surface.

13. A car body for a railway rolling stock according to claim 11, wherein the surface of the respective upper connecting members continuous to said outer surface of said roof means and the surface continuous to said outer surface of said side walls of said side means are connected at an angle greater than 90°.

14. A car body for a railway rolling stock according to claim 11, wherein the surface of the respective upper connecting members continuous to said outer surface of said roof means and the surface continuous to the outer surface of the respective side walls of said side means are connected at an angle greater than 90°, and wherein the surface of each of said lower connecting members continuous to the outer surface of the respective side walls of the side means and the surface continuous to the outer surface of said underframe means are connected at an angle greater than 90°.

15. A car body for a railway rolling stock according to claim 10, wherein each of said lower connecting members is formed by extending the first connecting end portion thereof to a position of a belt rails means provided in the side wall of the respective side wall means.

16. A car body for a railway rolling stock according to claim 10, wherein each of said upper connecting members is formed by extending the second connecting end portion thereof to a position of an upper side of at least one window opening portion provided in the respective side walls, and each of said lower connecting members is formed by extending the second end portions thereof to a position of a belt rail means provided in the side walls of the respective side wall means.

17. A method of fabricating a car body for a railway rolling stock, the car body including an underframe means, a pair of side means, a roof means, and a pair of end means separately constructed and subsequently combined, the method comprising the steps of providing upper connecting members constituted by at least one extruded shaped alloy member having at least one partition wall provided therein for forming at least one hollow portion extending continuously in a longitudinal direction of the car body, connecting the upper connecting members to upper sides of said side means to constitute said side means, and thereafter connecting the underframe means, the roof means, and the end means to the side means.

18. A method of fabricating a car body for a railway rolling stock in which modules forming the car body are separately constructed, said modules being subsequently combined to fabricate the car body, the method comprising the steps of arranging and connecting a roof outer sheet and a laterally extending member of one of the modules between two upper connecting members arranged in parallel to each other in a spaced relationship adjusted to a width of the car body to constitute an upper construction module of the car body, arranging and connecting cross beam means between two lower connecting members arranged parallel to each other in a spaced relationship adjusted to the width of the car body to constitute a lower construction module of the car body, holding the upper construction module of the car body, above the lower construction module of the car body leaving a space corresponding to a vertical dimension of a window opening portion of the car body, and connecting the opposed upper connecting members and lower connecting members through said post means.

* * * * *